United States Patent [19]

Wegewijs et al.

[11] 4,020,573

[45] May 3, 1977

[54] METHOD AND DEVICE FOR SUCKING UP A SOLID SUBSTANCE FROM A STOCK

[75] Inventors: Hendrik Franciscus Wegewijs, Utrecht; Tjako Aaldrik Wolters, Vianen, both of Netherlands

[73] Assignee: Ballast-Nedam Group N.V., Amstelveen, Netherlands

[22] Filed: Feb. 21, 1975

[21] Appl. No.: 551,549

[30] Foreign Application Priority Data

Feb. 25, 1974 Netherlands ..... 7402559

[52] U.S. Cl. ..... 37/63; 37/58; 37/DIG. 8; 299/8; 299/17

[51] Int. Cl.[2] ..... E02F 3/88; E02F 7/00

[58] Field of Search ..... 37/57, 58, 59, 68, DIG. 8, 37/61, 62, 63; 299/8, 16–18; 61/50–52

[56] References Cited

UNITED STATES PATENTS

| | | | |
|---|---|---|---|
| 168,278 | 9/1875 | Newton | 37/63 |
| 1,147,401 | 7/1915 | Huttner | 37/59 X |
| 1,533,465 | 4/1925 | Rowe | 37/63 |
| 1,985,401 | 12/1934 | Callahan | 37/59 X |
| 2,125,740 | 8/1938 | Schacht | 37/57 X |
| 2,144,743 | 1/1939 | Schulz | 37/57 |
| 2,678,203 | 5/1954 | Huff | 37/63 X |
| 2,960,368 | 11/1960 | Watanabe | 37/63 X |
| 3,180,040 | 4/1965 | Ballam | 37/59 |
| 3,495,409 | 2/1970 | Riedemann | 37/58 X |
| 3,504,943 | 4/1970 | Steele et al. | 37/59 X |
| 3,585,738 | 6/1971 | De Koning | 37/57 |
| 3,585,739 | 6/1971 | De Koning | 37/57 X |
| 3,589,040 | 6/1971 | De Koning | 37/58 |
| 3,611,595 | 10/1971 | De Koning | 37/58 |
| 3,618,236 | 11/1971 | Pipkin | 37/63 |
| 3,628,263 | 12/1971 | Van Der Veen | 37/58 |
| 3,630,400 | 12/1971 | De Koning | 37/58 X |
| 3,645,018 | 2/1972 | De Koning | 37/58 |
| 3,681,862 | 8/1972 | De Koning | 37/58 |
| 3,750,408 | 8/1973 | Hartog | 37/58 X |
| 3,756,659 | 9/1973 | De Koning | 37/58 X |
| 3,772,805 | 11/1973 | De Koning | 37/58 |

*Primary Examiner*—E. H. Eickholt
*Attorney, Agent, or Firm*—Snyder, Brown & Ramik

[57] ABSTRACT

In a method for drawing at least one fraction of solid substance by suction from a heterogeneous stock of several solid substances, which are segregated according to granular size and/or specific weight by supplying a segregation fluid, for example water, into a segregation zone at a distance from a suction nozzle of a suction pipe held in the stock, a selected fraction of segregated solid substances together with the fluid being conducted away in the form of a suspension through the suction nozzle water is vigorously injected into a ground layer for washing out the soil so that a fraction of fine grains is picked up in a whirl and can thus be directly sucked off through the suction pipe. With this method it cannot be avoided that both fine and coarse grains are sucked up together by one and the same suction nozzle.

This method is improved according to the invention in that for creating a segregation zone, from which a downward stream of a fraction of coarser and/or heavier solid substance and an upward stream of a fraction of finer and/or lighter solid substance emanate, the segregation fluid is inserted into the stock at such a distance from the suction nozzle that only the stream containing the selected fraction is subjected to the action of the suction nozzle.

21 Claims, 3 Drawing Figures

FIG. 1
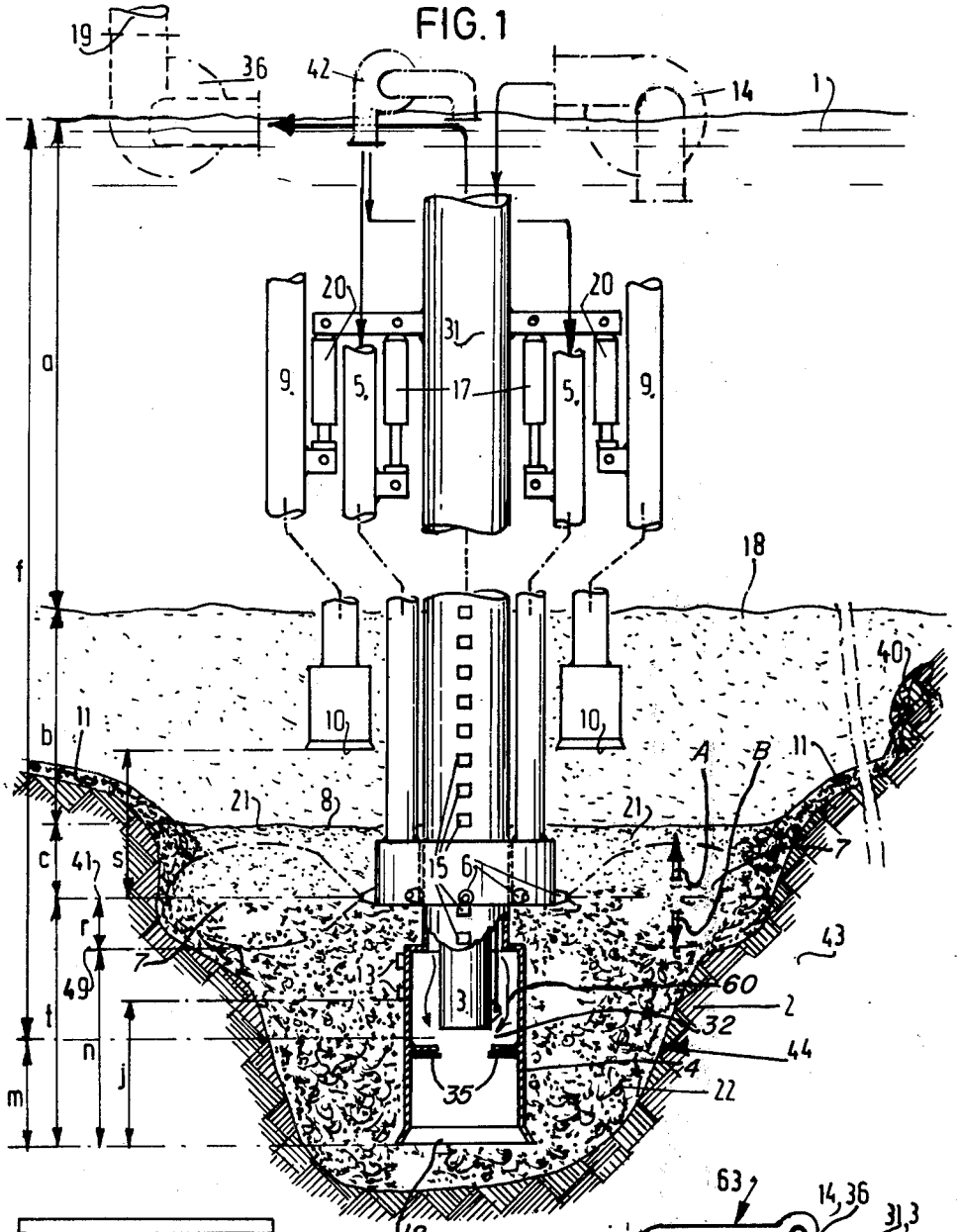
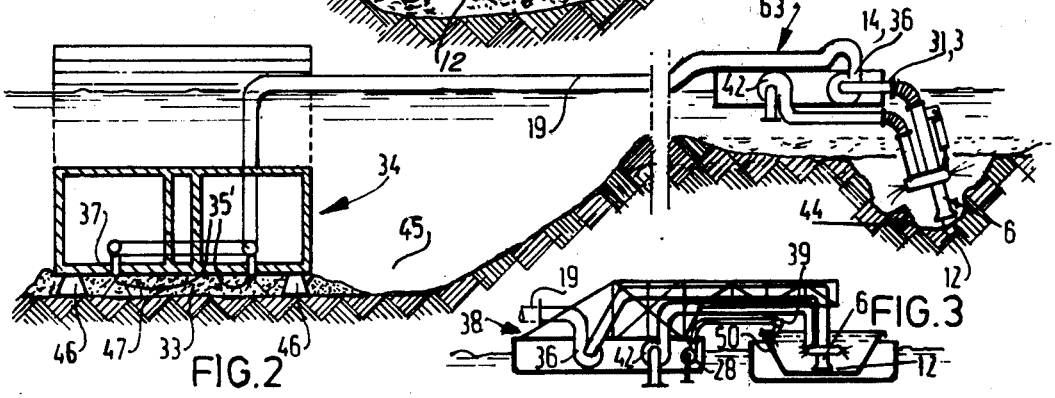
FIG. 2
FIG. 3

METHOD AND DEVICE FOR SUCKING UP A SOLID SUBSTANCE FROM A STOCK

The invention relates to a method and a device for drawing at least one fraction of solid substance by suction from a heterogeneous stock of several solid substances, which are segregated according to granular size and/or specific weight by supplying a segregation fluid, for example, water into a segregation zone at a distance from a suction nozzle of a suction pipe held in the stock, a selected fraction of segregated solid substances together with the fluid being conducted away in the form of a suspension through the suction nozzle.

This method and this device are known from the U.S. Pat. No. 1,533,465.

In this known method and device the water is vigourously injected into a ground layer for washing out the soil so that a fraction of fine grains is picked up in a whirl and can thus be directly sucked off through the suction pipe. The fraction of coarser grains, such as stones, has to be left in the soil. With this known method it cannot be avoided that both fine and coarse grains are sucked up together by one and the same suction nozzle because the suction nozzle exerts a suction force on the segregation zone so that both the upward stream and the downward stream are subjected to the suction effect of the suction nozzle. Since segregation is performed with the aid of segregation water which participates in the whirl of the fine grain fraction in the segregation zone, the concentration of solid substance in the suspension sucked is low. The invention has for its object to provide an improvement in the segregation of one fraction from the other fractions.

The improvement provided by this invention resides in that for creating a segregation zone, from which a downward stream of a fraction of coarser and/or heavier solid substance and an upward stream of a fraction of finer and/or lighter solid substance emanate, the segregation fluid is inserted into the stock at such a distance from the suction nozzle that only the stream containing the selected fraction is subjected to the action of the suction nozzle.

A preferred method for winning pure sand from a stock containing sand contaminated, for example by mire located in the bottom of a watercourse or in a transport hopper is characterized in that the segregation water initiates and maintains the segregation of the impure sand from the stock so that the lighter and/or finer impurities escape in upward direction and the heavier and/or coarser sand moves downwards in the form of a thick liquid suspension of sand and water and enters the suction nozzle, whilst the supply of segregation water is held at a sufficiently large distance from the suction nozzle to avoid that the upward stream containing the impurities should be affected by the action of the suction nozzle to an extent such that it might be sucked in together with the pure sand by the suction nozzle.

The pressure at which the segregation fluid is supplied is preferably regulated in dependence upon the height of the downward stream of pure sand above the suction nozzle.

It is preferred to use the pressure of the downward stream for regulating the height of the fluid nozzle with respect to the suction nozzle and/or the pressure of diluting water supplied into the suction pipe in order to avoid the risk of the rising stream containing the mire being subjected to the action of the suction nozzle and entering the same.

The invention provides furthermore a device for carrying out the method in accordance with the invention, said device comprising a supply suction pipe connected with a pump and having at least one nozzle for the supply of a segregation fluid into a heterogeneous stock of several solid substances and a suction pipe connected with a pump and having a suction nozzle, the device being characterized in that the distance between the fluid nozzle and the suction nozzle is at least so large that solely the stream containing the selected fraction is affected by the suction nozzle.

A preferred embodiment of the device in accordance with the invention is particularly suitable for winning mire-free sand and is characterized in that the distance of the fluid nozzle from the suction nozzle is at least twice the diameter of the suction pipe.

The above-mentioned and further features of the invention will be set out more fully in the following description with reference to the drawing.

In the drawing

FIG. 1 shows schematically a preferred embodiment of the device for carrying out the method in accordance with the invention and FIGS. 2 and 3 show each a variant of the device in accordance with the invention.

Referring now to FIG. 1 a suction pipe 3 provided with an inlet chamber 4 and connected with a pump 36 is inserted into an underwater stock 2 of a heterogeneous mixture of solid substances of different specific weight and/or grain size. In order to win with certainty a solid substance of a preferred grain size and/or specific weight, for example mire-free sand from the stock 2 water as a segregation fluid is supplied at an excess pressure by means of a plurality of nozzles 6 connected by way of pressurized water ducts 5 with a pump 42 to the segregation zone 7 of the stock 2, where owing to differences in gravitational speed and specific weight a rising stream A is produced, which carries along the lighter and/or finer constituents such as mud across the fluid mixture 21 of solid substances from the stock 2 towards an upper level 8.

The suspension 18 of lighter and/or finer solid substances such as mud with water floats on the upper level 8 of the fluid mixture 21 of solid substances and water, behaving like a thick liquid from the stock 2.

The lighter and/or finer fraction, for example, mire is preferably conducted away by means of suction nozzles 10 of additional exhaust pipes 9. In the segregation zone 7 is furthermore produced a downward stream B containing the suspension 22 of the heavier and/or coarser fraction liberated from the light and/or fine fraction, said stream being exposed on the bottom side to the pressure difference generated by means of the pump 36 between the suction nozzle 12 of the inlet chamber 4 and the segregation zone 7 so that the stream is taken by the suction nozzle 12 and conducted via the inlet chamber 4 and the suction pipe 3 by means of the pump 36 way to a transport duct 19.

As the suction pipe 3 penetrates further into the stock 2 by suction, breaking off lumps 40 will produce heterogeneous suspensions 11, which may arrive even from comparatively large distances. For this reason the quantity of disintegrated fluid mixture around the suction pipe 3 may always vary in an unpredictable manner. In order to maintain a correct distance *t* between the segregation fluid nozzles 6 and the suction nozzle 12 pressure probes 13 may be arranged in the downward stream B above the suction nozzle 12. By means of the pressure difference measured by said probes 13 the specific weight of the fraction contained in the downward stream B can be determined and this pressure difference may be employed for regulating the pressure of supplied fluid and/or the distance $t$. The distance $t$ is adjusted by means of jack-screws 17. A second series of pressure probes 15 may be arranged on the suction pipe 3 for measuring pressure differences in the stock 2 between the levels of said pressure probes 15. By comparing these pressure differences with one another it is possible to determine inter alia the height of the upper level 8, which is the interface between the fluid mixture 21 and the suspension of the light fraction 18. The inlet chamber 4 is preferably connected with a separate pressurized water supply duct 31 associated with a pump 14 of adjustable pressure in order to reduce at will the concentration of sand in the suspension sucked in by the suction pipe 3. By determining the height of the upper level 8 the distance $s$ between the suction nozzle 10 and the fluid nozzles 6 can be adjusted by means of jack-screws 20 with respect to the suction pipe 3 so that solely the suspension of the light-weight fraction 18 is conducted away by said suction nozzles 10.

Hereinafter the state of equilibrium will be accounted for which exists for a suction pipe 3 inserted into a stock 2, for example, the soil 43 (FIG. 2) or in a hopper 50 (FIG. 3) containing slush, the stock 2 consisting, for example, of sand contaminated by mire, from which pure sand has to be sucked up.

Referring to FIG. 1, the water 1 has a depth $a$, the mud layer 18, which may be conducted away, as the case may be, by additional suction means, has a thickness $b$, the layer 21 of fluid mixture of comparatively low specific weight due to mud contained in the rising current has a thickness $c$ above the segregation fluid nozzles 6 and a layer of comparatively heavy, thick liquid containing mud-free sand 22 has a thickness $t$ between the suction nozzle 12 and the fluid nozzles 6.

In this region of the fluid nozzles 6 the segregation zone 7 has a suspension of varying specific weight, but for purpose of an approximate calculation of the minimum admissible height $t$ of the fluid nozzles 6 with respect to the suction nozzle 12 this is negligible.

In order to avoid a short-circuit of the segregation zone 7 by the suction nozzle 12, in which case it is not certain whether mud-free sand will be obtained, the distance $n$ between the segregation zone 7 and the suction nozzle 12 must not be too small. With a height $f$ of the pump 36 above the inlet 32 of dilution water and with a minimum suction pressure $P_m$ of 2 m water column of the pump 36 there follows from the dynamic equilibrium with respect to the level 41 of the fluid nozzles 6 the formula:

$$\text{Atmospheric pressure} + a.V_w + b.V_s + c.V_k = P_m + f.V_a + m.V_z - C_f - C_i - t.V_z \quad \text{(I)}$$

In this formula:

$m$ is the distance of the inlet 32 above the suction nozzle 12, $V_w$ the specific weight of water = 1, $V_z$ the specific weight of the heavy suspension e.g. = 2.0, $V_s$ the specific weight of mud e.g. = 1.2, $V_a$ the specific weight of the suspension in the suction pipe 3, depending upon the delivery capacity of the device, $V_k$ the mean specific weight of the fluid mixture across the layer 21 e.g. = 1.4, $C_f$ the flow resistance in the suction pipe 3, $C_i$ the entrance flow resistance of the suspension 22 up to the suction pipe 3, $$t = \frac{P_m + f.V_a + m.V_z - 10 - a.V_w - b.V_s - c.V_k + C_f + C_i}{V_z}$$

Substituting the above-mentioned values formula I becomes as follows:

$$t = 1 + \tfrac{1}{2} f.V_a + m - 5 - \tfrac{1}{2}a - 0.6b - 0.7c + C_f + C_i.$$

If at the inlet 32 no diluting water is introduced, $V_a = V_z = 2$.

$$t = (f + m) - \tfrac{1}{2}a - 0.6b - 0.7c - 4 + C_f + C_i \quad \text{(II)}$$

Since a satisfactorily operating segregation zone covers a depth $r$ of less than 2 meters beneath the fluid nozzle 6, $t = n+2$. Then the level difference $n$ between the suction nozzle 12 and the interface 49 is determined by the formula $$n = f + m - \tfrac{1}{2}a - 0.6b - 0.7c - 2 + C_f + C_i \quad \text{(III)}$$

Under given suction conditions the entrance flow of heavy suspension 22 is determined by the entrance flow resistance $C_i$, representing the suction effect of the suction nozzle 12. This suction action does not affect the segregation zone 7, if the column of heavy suspension has a height $n$ and a weight exceeding $C_i$, which may, in practice, be 1.5 ms water column.

$$n.V_z > C_i$$

$$n > (1.5/2.0)$$

$$n > 0.75 \text{ m.}$$

For reasons of safety the pressure gauges 13 are, therefore, arranged at a level slightly higher than the limit distance $j$ of 0.75 m above the suction nozzle 12. As long as the pressure gauges 13 assess a specific weight of 2.0, the segregation obtained in accordance with the invention is perfect, since in this case the segregation zone 7 does not attain the level of the limit height $j$. However, in most cases the pump 36 and/or the transport duct 19 will not be capable of handling a $V_z$ of 2.0 so that diluting water has to be supplied to the inlet chamber 4. As will be apparent from formula III, this has its direct consequence for the minimum height of the column $n$, since the term $f$ then decreases.

Before inserting a suction pipe into the stock for winning mud-free sand a suction pit has to be made. The suction pipe 3 is filled with water for washing out a suction pit 44 in the stock 2 to a depth ensuring an adequate supply of fluid suspension 11 for a given period. By forming such a pit sucking up of sand contaminated by mud during the initial stage is avoided.

If the average supply of fluid mixture 11 is approximately equal to the quantity of mud-free sand sucked up, the fluctuations of the supply can be compensated for by regulating the pressure of the segregation water supply and/or by regulating the height $t$ and hence the distance $n$ of the segregation zone from the suction nozzle 12.

In the event of an excessive feed of fluid mixture 11 from the stock 2 to the segregation zone 7 the interface 8 rises and the heavy suspension 22 flowing towards the suction nozzle 12 has to be retained for example by means of a controllable throttle 35 and/or by reducing the specific weight $V_z$ of the incoming sand suspension of about 2. In order to dilute the suspension 22 in the inlet chamber 4 to the required $V_a$ of, for example, 1.4 diluting water is added.

It has been found to be possible in certain regions to withdraw sand-containing suspensions from quite remote stocks as shown in FIG. 1 by making a suction pit. When the available quantity of pure sand 22 in the suction pit 44 drops, the suction pipe 3 has to be moved to a lower level. This involves the risk of sucking up mud-containing sand from the stock 2 located beneath the suction pit 44. If it is required to supply absolutely mud-free sand, for example, for tunnel foundations, it is necessary to insert water rather than exerting suction.

FIG. 2 shows by way of example an arrangement for submerging in mud-free sand a tunnel section 34 held on provisional supports 46 in a dredged ditch 45 above the bottom 47 of the ditch 45.

A dredger 63, floating on the water 1, carries the suction pipe 3 of FIG. 1 and the pump 36, with which the transport duct 19 is connected. The separate feeds of dilution water 60 and segregation water are performed by pumps 14 and 42 arranged on the vessel. By means of the fluid nozzles 6 and the suction pit 44 a segregation zone 7 is created so that the mud is released and can flow towards the upper mud layer 18. In the suction pit 44 a layer of mud-free sand 22 is then formed around the suction nozzle 12. This mud-free sand gained from the soil 43 is fed via the transport duct 19 and conveyed through feed openings 35' in the bottom 37 of the tunnel section 34 to form a foundation layer 33 beneath the tunnel section 34.

As an alternative, sand can be supplied in a hopper 50, which is emptied by suction as shown in FIG. 3 by means of a hopper dredger 38, which is also provided with a suction pipe 3 substantially as shown in FIG. 1 with a pump 36 and nozzles 6 associated with a pump 42 and a suction nozzle 12. By means of at least one water spray connected with a pump 28 the stock 2 is disintegrated. In order to suck up mud-free sand first a suction pit 44 is made in the hopper 50 as described above with reference to FIG. 1.

The above described methods are preferably continuously performed.

What we claim is:

1. The method of winning pure sand from a mixture of sand and mud which comprises the steps of:

a. injecting water into the mixture to form a pocket of fluidized sand from which the mud has been upwardly flushed;

b. maintaining said pocket of fluidized sand by injecting water within said pocket to form a segregation zone extending across the mouth of the pocket;

c. controlling the injected flow of step (b) such that mud cannot penetrate through said segregation zone and thus remains above the segregation zone while sand may penetrate through said segregation zone and flow into said pocket;

d. withdrawing a suspension of sand in water at a withdrawal region spaced below said segregation zone and conveying it to a remote discharge region; and e. controlling the spacing of said withdrawal region below said segregation zone to be sufficiently great as to preserve the integrity of said segregation zone.

2. The method as defined in claim 1 including the step of introducing diluting water at said withdrawal region to control the density of the suspension withdrawn in step (d).

3. The method as defined in claim 2 including the step of measuring the density of fluid at vertically spaced points within said pocket between said withdrawal region and said segregation zone and effecting the control of step (b) in accord with such measurements.

4. The method as defined in claim 2 including the step of measuring the density of fluid at vertically spaced points within said pocket between said withdrawal region and said segregation zone and effecting the control of step (e) in accord with such measurements.

5. The method as defined in claim 2 including the step of measuring the density of fluid at vertically spaced points within said pocket between said withdrawal region and said segregation zone and controlling the introduction of diluting water in accord with such measurements.

6. The method as defined in claim 1 including the step of measuring the density of fluid at vertically spaced points within said pocket between said withdrawal region and said segregation zone and effecting the control of step (b) in accord with such measurements.

7. The method as defined in claim 1 including the step of measuring the density of fluid at vertically spaced points within said pocket between said withdrawal region and said segregation zone and effecting the control of step (e) in accord with such measurements.

8. The method of winning at least one fraction from a stock which is a heterogeneous mixture of said one fraction and at least one other fraction which is of smaller particle size and/or specific weight, which comprises the steps of:

a. maintaining a pocket of fluidized stock by injecting segregation fluid within said pocket to create a segregation zone across the mouth of said pocket;

b. controlling the injected flow of step (a) such that said segregation zone prevents said other fraction from penetrating through said segregation zone while allowing said one fraction to penetrate through said segregation zone and enter said pocket;

c. withdrawing fluidized stock from a withdrawal region in said pocket spaced below said segregation zone and conveying it to a remote discharge region;

d. controlling the withdrawal of step (c) such that said one fraction is entrained and carried along to said discharge region; and e. controlling the spacing of said withdrawal region below said segregation zone to be sufficiently great as to preserve the integrity of said segregation zone.

9. The method as defined in claim 8 including the step of withdrawing said other fraction from a second withdrawal region spaced above said segregation zone.

10. The method as defined in claim 9 including the step of controlling the spacing of said second withdrawal region relative to said segregation zone.

11. The method as defined in claim 8 including the step of measuring the density of fluid at vertically spaced points between said withdrawal region and said segregation zone, and effecting the control of step (e) in accord with such measurements.

12. The method as defined in claim 10 including the step of measuring the density of fluid at vertically spaced points between said segregation zone and said second withdrawal region, and effecting the control of the spacing between said segregation zone and said second withdrawal region in accord with such measurements.

13. The method as defined in claim 12 including the step of measuring the density of fluid at vertically spaced points between said withdrawal region first mentioned and said segregation zone, and effecting the control of step (e) in accord with the measurements last mentioned.

14. The method of sucking up at least one fraction of particulate solid substances from a heterogeneous stock of several particulate solid substances which have different granular size and/or specific weight, which comprises the steps of:

a. maintaining a pocket of fluidized stock by injecting segregation fluid within the pocket by means of injection nozzle means located in spaced relation relation above the bottom of the pocket, the rate of injection being such as to create an upwardly flowing stream of segregation fluid above said injection nozzle means which at least suspends those fractions of the stock which are of particle size finer and/or lighter than said one fraction while allowing said one fraction and any fractions coarser and/or heavier than said one fraction to migrate downwardly into said pocket; and b. withdrawing fluidized stock from said pocket below said injection nozzle means by means of suction nozzle means and conveying it to a remote discharge zone, the rate of withdrawal of fluidized stock being such as to entrain and carry along said one fraction and said suction nozzle means being spaced below said injection nozzle means by an amount sufficiently great that those fractions which are at least suspended by said upwardly flowing stream are unaffected by the action of said suction nozzle.

15. The method as defined in claim 14 including the steps of controlling the spacing between said suction nozzle means and said injection nozzle means to be sufficiently great that those fractions which are at least suspended by said upwardly flowing stream are unaffected by the action of said suction nozzle.

16. The method as defined in claim 15 wherein said fluid injected in step (a) is directed laterally within said pocket.

17. The method as defined in claim 14 including the step of withdrawing at least a fraction of smaller particle size and/or specific weight by means of second suction nozzle means located above said injection nozzle means.

18. The method as defined in claim 14 including the steps of directing said one fraction withdrawn in step (b) beneath a submerged tunnel section to fill a space between the tunnel section and the underlying bottom.

19. Apparatus for winning one particulate fraction contained in a mixture of said one fraction and at least one other particulate fraction which is of smaller particle size and/or specific weight than said one fraction, comprising in combination:

an elongate suction pipe having a suction nozzle for withdrawing a suspension of said one fraction;

a ring of fluid injecting nozzles surrounding said suction pipe and fluid pump means connected to said ring of nozzles for delivering fluid under controllably variable pressure through said ring of nozzles; and means mounting said ring of nozzles for controlling the spacing between said ring of nozzles and said suction nozzle.

20. Apparatus as defined in claim 19 wherein said spacing between the suction nozzle and said ring of nozzles is at least twice the diameter of said suction pipe.

21. Apparatus as defined in claim 19 including a dilution fluid supply pipe surrounding said suction pipe and communicating with the interior of said suction nozzle, and pump means for variably supplying dilution fluid through said supply pipe.

* * * * *